US006286669B1

(12) United States Patent
Collie

(10) Patent No.: US 6,286,669 B1
(45) Date of Patent: Sep. 11, 2001

(54) SMALL HANDYMAN PACK

(75) Inventor: Nelson Collie, 83 Albert Street, Invercargill (NZ)

(73) Assignees: Michael Fraher, Christchurch; Nelson Collie, Invercargill, both of (NZ)

( * ) Notice: Subject to any disclaimer, the term of this patent is extended or adjusted under 35 U.S.C. 154(b) by 0 days.

(21) Appl. No.: 09/491,750

(22) Filed: Jan. 28, 2000

(30) Foreign Application Priority Data

Jan. 28, 1999 (NZ) ..... 333961

(51) Int. Cl.[7] ..... B65D 25/08; B65D 73/00

(52) U.S. Cl. ..... 206/220; 206/229; 206/462; 206/469; 206/568; 206/582

(58) Field of Search ..... 206/219, 220, 206/229, 230, 461, 462, 469, 471, 568, 582, 531, 532

(56) References Cited

U.S. PATENT DOCUMENTS

| | | | | |
|---|---|---|---|---|
| 3,282,413 | * | 11/1966 | Sparks | 206/462 |
| 3,302,772 | * | 2/1967 | Finkelston, Jr. et al. | 206/532 X |
| 3,327,843 | * | 6/1967 | O'Meara et al. | 206/462 X |
| 4,008,803 | * | 2/1977 | Smith | 206/220 |
| 4,081,077 | * | 3/1978 | Franck | 206/219 |
| 4,341,202 | * | 7/1982 | Baker et al. | 206/219 |
| 4,457,427 | * | 7/1984 | Cafiero | 206/229 |
| 5,333,737 | * | 8/1994 | Clark | 206/568 |
| 5,613,609 | * | 3/1997 | Hamilton et al. | 206/531 |

FOREIGN PATENT DOCUMENTS

| | | | | |
|---|---|---|---|---|
| 1583614 | * | 1/1981 | (GB) | 206/568 |
| 267279 | | 2/1998 | (NZ) . | |

* cited by examiner

*Primary Examiner*—Bryon P. Gehman
(74) *Attorney, Agent, or Firm*—Merchant & Gould P.C.

(57) ABSTRACT

An easy to use handyman package for storage and application of one or more contents, such as a two part reactive adhesive and applicator. The package consists of a backing card, a membrane, and a blister cover sheet. The backing card is formed with a number of holes, and a membrane covers the card to seal the holes. A blister cover sheet is laminated to the membrane and includes a number of blisters which correspond in position to the holes formed in the backing card. In one example the package can have three blisters containing two reactive substances and an applicator. During use, folding motion of the package causes the contents to erupt from the package, allowing mixing, application, and disposal an easy task.

17 Claims, 3 Drawing Sheets

SMALL HANDYMAN PACK

FIELD OF THE INVENTION

The invention relates to packaging.

BACKGROUND OF THE INVENTION

Current small handyman epoxy packs have the disadvantage that they tend to leak once the seals are broken, thus leaving sticky deposits wherever they are stored between usage. Invariably the exteriors of such packs become contaminated with the leaked contents making handling unpleasant as well as hazardous to sensitive skin and eyes.

In addition consumers often only require a small amount of adhesive to perform the task at hand, inevitably one or both containers of twin packs can become mislaid after use, resulting in the need to purchase a complete now dual package without having enjoyed the use of all the contents of the original packs.

An object of the present invention is to provide a complete one-use package including the applicator and mixing platform as integral parts.

A further object of the invention is to provide packaging that allows the user to completely avoid skin contact with the contents and can easily and cleanly be disposed of after use.

Further objects and advantages of the invention will become apparent from the following description which is given by way of example only.

SUMMARY OF THE INVENTION

According to the invention there is provided a handyman package for single or two part contents including:

- a backing card formed with a plurality of holes;
- a membrane fixed to the backing card so as to cover and seal said holes;
- a cover sheet laminated to said membrane and backing card and including a corresponding number of blisters as there are holes formed in the backing card, such that when the cover shoot is laminated over the membrane and backing card each blister is positioned over a sealed hole in the backing card.

Preferably the package has three blisters, corresponding to three holes in the backing card, such that a first blister contains a first contents, a second blister contains a second contents and a third blister contains a applicator.

Preferably the first contents may be a first part of a two part reactive adhesive and the second contents may be a second part of a two part reactive adhesive.

Preferably the backing card is provided with a first and a second fold line such that the two fold lines on opposite surfaces which divide the backing card into three sections that can be folded in a zigzag Z shape.

Preferably the first and second blisters are oval in shape and are located on the middle section of the backing card along with their corresponding holes.

Preferably the third blister is elongated in shape and is positioned substantially in the third section of the backing card, but partly positioned across the second fold line dividing the second and third sections and with its corresponding hole also partially across said fold line such that when the third section of the backing card is folded forward through 90° the applicator is caused to erupt through the membrane covering said hole and can be withdrawn from the third blister. The applicator is used to rupture the membrane sealing the holes corresponding to the first and second blisters.

Preferably when the third section of the backing card is folded through 180° it will crush the first and second blisters, discharging the contents of the blisters through their corresponding holes and onto the back of the backing card. The back of the backing card can now be used as a platform for mixing and/or distribution of the first and second contents.

Preferably an additional hole is punched through the packaging in the first section of the backing card. This hole may be used to suspend the packaging from a display stand.

Once the contents have been used for the task at hand, the first section of the backing card is folded backward 180° along the first fold line so as to meet the second section and enclose the surface of the platform and any unused contents thereon. Preferably the applicator is inserted through the additional hole in the first section, the hole corresponding to the third blister and into the third blister such that it holds the folded packaging flat in a zigzag orientation, thus making it cleanly and easily disposed of.

Thus according to the invention, there is provided a package which includes a first and a second contents, a applicator, a platform, a means of transferring both of the contents to the platform, and a means for easily and cleanly preparing the packaging for disposal after use.

Further aspects of the invention will become apparent from the following description, which is given by way of example only.

While the present example relates specifically to two part reactive adhesives, in particular epoxy resin, the principles involved readily lend themselves to other products requiring one-use disposable packaging such as single pot adhesives, point tinters, poison baits, dental impression, filling materials, shampoo and conditioner, fuel and lubricant additives/products and many more.

BRIEF DESCRIPTION OF THE DRAWINGS

Examples of the invention will now be described with reference to the accompanying drawings in which.

DETAILED DESCRIPTION OF THE INVENTION

Figure 1:
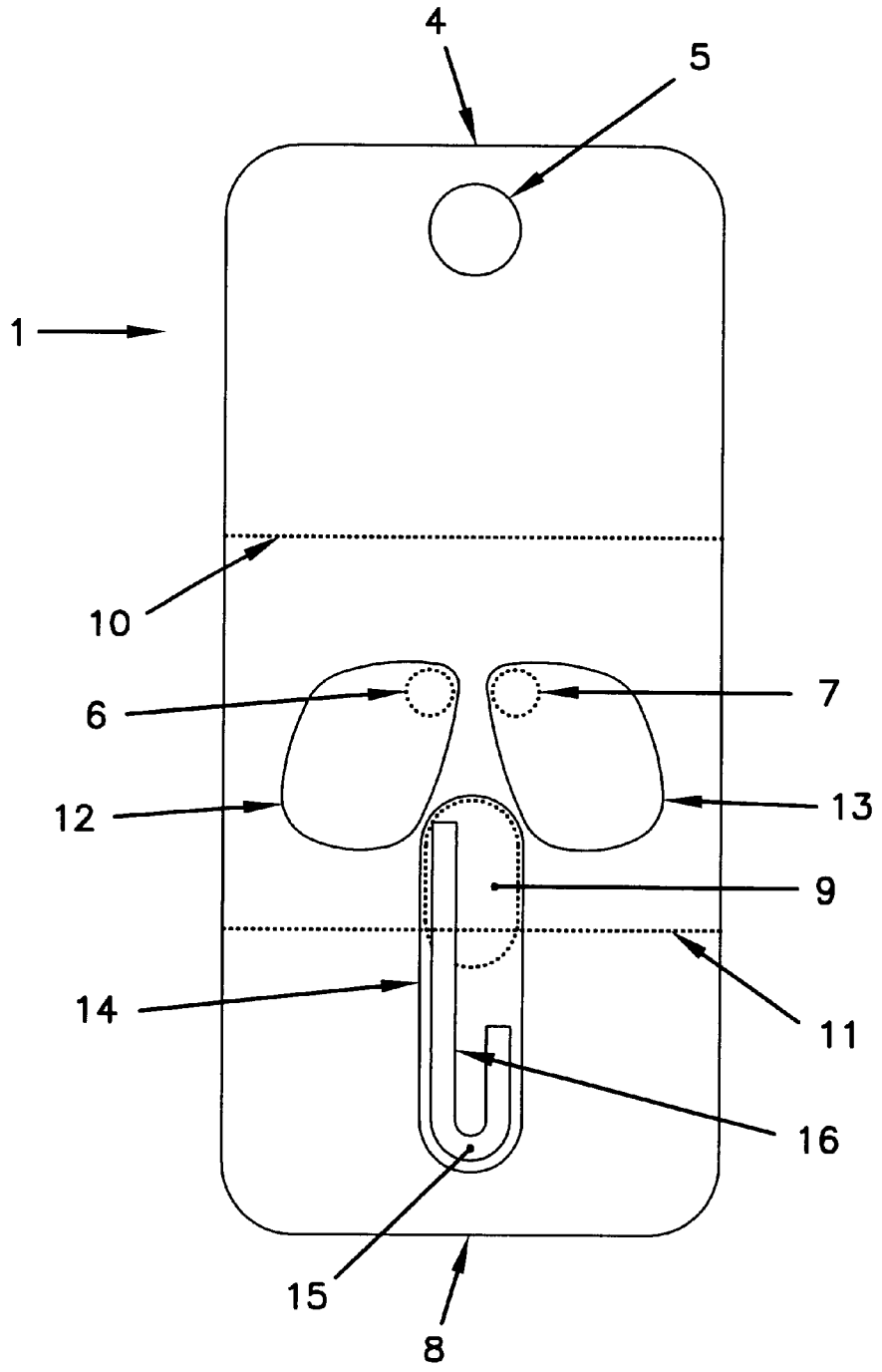
FIG. 1: illustrates a front view of a two-part epoxy adhesive package.
Figure 2:
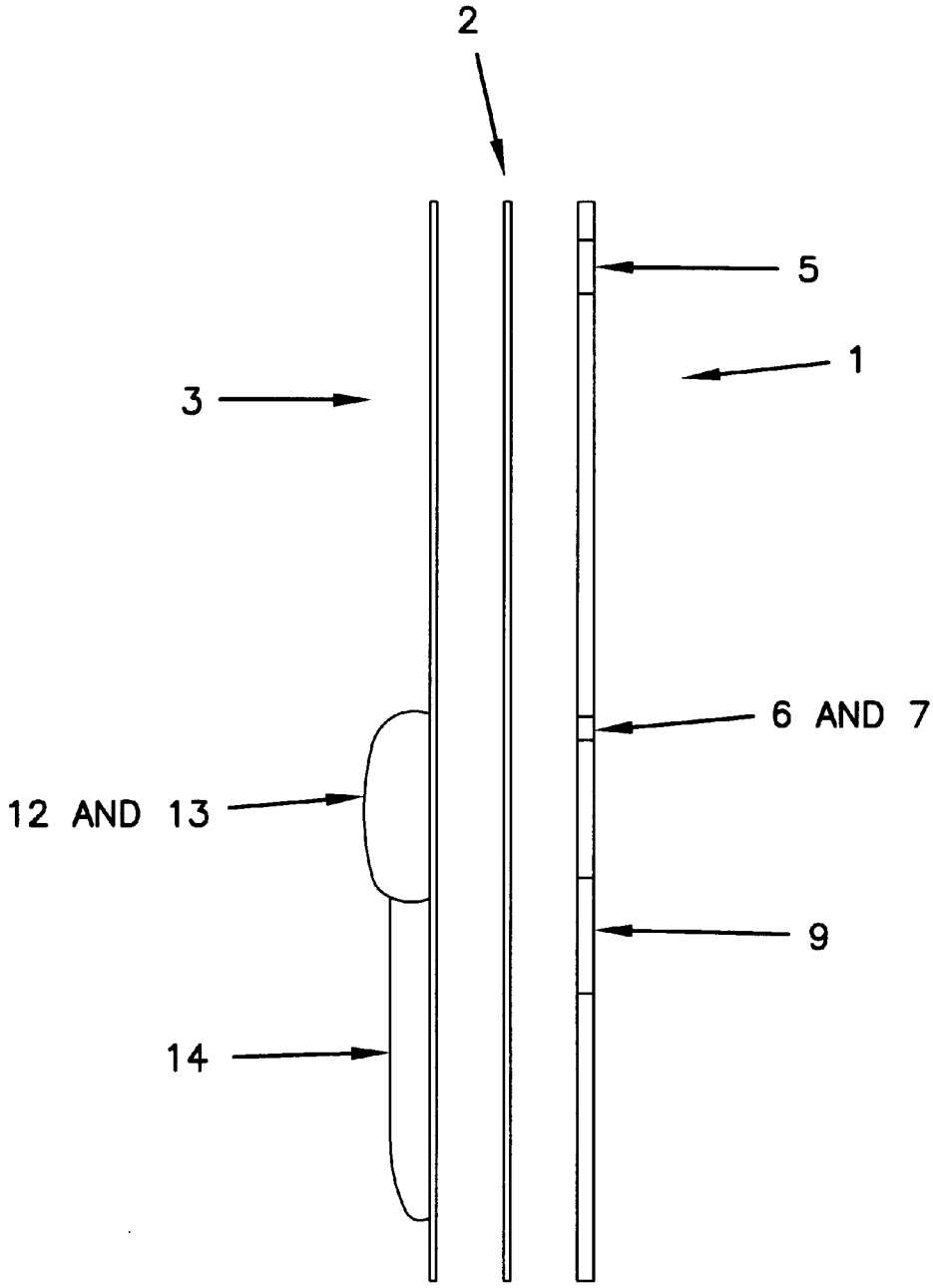
FIG. 2: illustrates a side view of a two-part epoxy adhesive package showing the three laminated components exploded apart.
Figure 3:
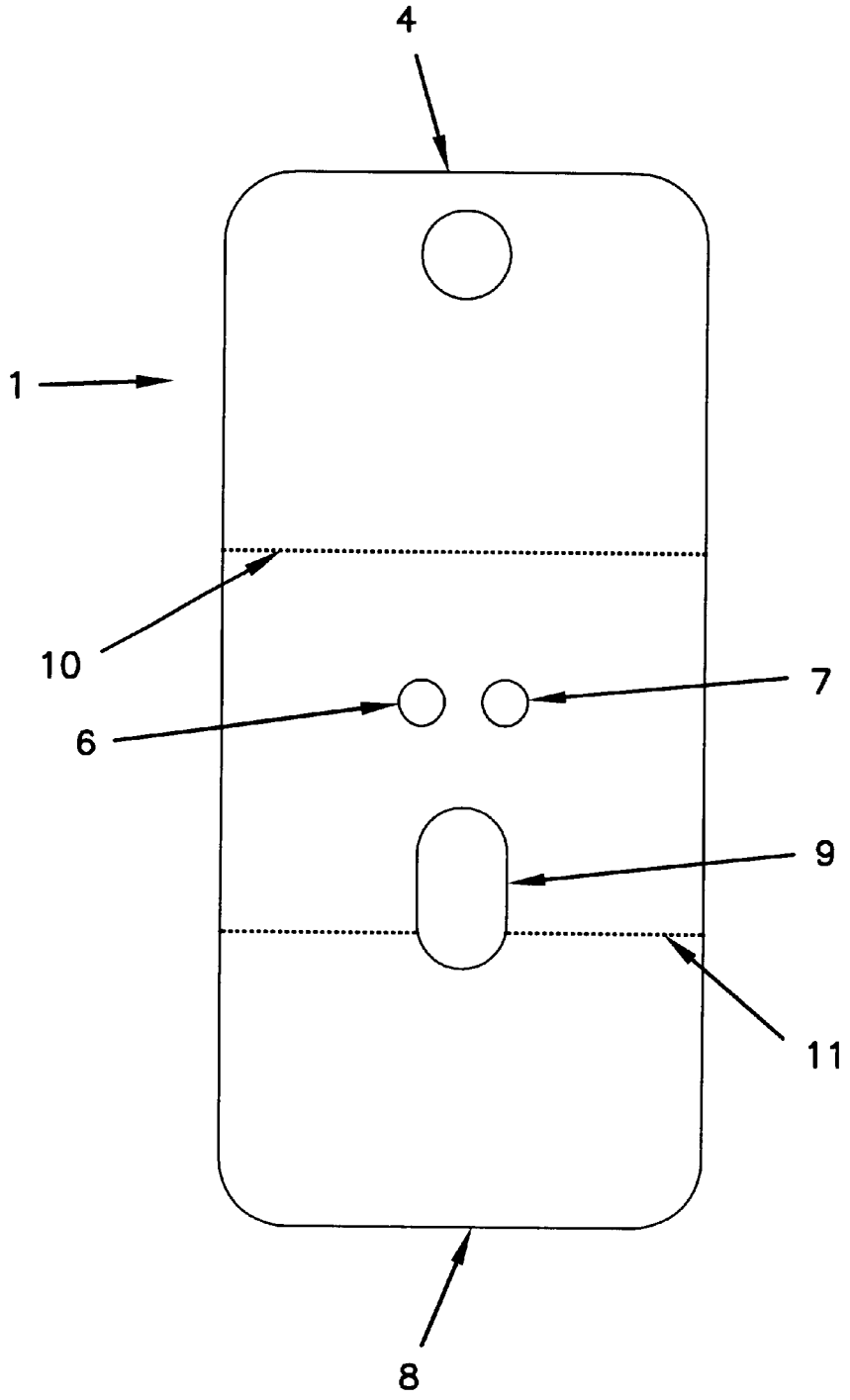
FIG. 3: illustrates a back view of a two-part epoxy adhesive package.

The packaging consists of a rectangular backing card 1 about 145 mm long and about 65 mm wide, a membrane 2, and a three blister cover sheet 3, laminated together.

The centre point of the backing card 1 is formed with two 6 mm holes 6,7 centred at 10 mm across the short axis. A third 22 mm×12 mm oval hole 9 is formed 48 mm from the second end 8 of the backing card 1, with its long axis parallel to the long axis of the backing card 1. The first end 4 of the backing card 1 is provided with a 12 mm hole 5 centred 11 mm front the first and 4. This hole is also formed through the membrane, and provides a means for hanging the packaging from display boards and stands.

The backing card 1 is provided with two fold lines 10, 11 across its width. The fold lines 10,11 are preferably on opposite sides of the backing card. The first fold line 10 is 50 mm from the first end 4 of the backing card 1, and the second fold line 11 is 40 mm from the second end 8 of the backing card 1 and passes through the oval hole 9.

The three blister sheet 3 is laminated over the membrane 2 on the front of the backing card 1. The blister sheet 3 covers the full width of the backing card 1 but is only 90 mm long and positioned so as to cover the area of the backing card 1 between its second end 8 and the first fold line 10.

The three blisters on the blister sheet 3 are formed and positioned so as to each cover one of the two 6 mm holes 6,7 and the oval hole 9 in the backing card 1. The two blisters 12, 13 corresponding to the 6 mm holes 6, 7 are oval shaped. The first blister 12 contains a first part of the reactive adhesive and the second blister 13 contains a second part of the reactive adhesive.

The third blister 14 is elongated in shape and contains the applicator 15. The membrane 2 laminated between the backing card 1 and the blister sheet 3 retains the two parts of the reactive adhesive and the applicator 15 within their respective blisters.

To open the peck, the backing card 1 is held with the blister sheet 3 facing down (back of the backing sheet facing) and proximal to the user. The second end of the card is folded downwards so that the card bonds along the second fold line 11. This causes the applicator 15 to erupt through the membrane 2 sealing the oval hole 9. The user can remove the applicator 15 from the elongated blister 14 through the oval hole 9.

The applicator 15 can be used to puncher the membrane 2 sealing the 6 mm holes 6,7. The second end 8 of the backing 1 is now folded through a further 90° (making a total of 180°), causing it to crush the oval blisters 12, 13 and expelling the two parts of the adhesive out through the 6 mm holes 6,7. The two parts of the adhesive will now be on the back of the backing card 1 where they can be mixed using the applicator 15.

When the adhesive has been used, the first end 4 of the backing card 1 is folded up through 180°, causing the card to bend at the fold line 10 such that the 12 mm hole 5 lines up with the oval hole 9. The sticky mixing surface and any remaining resin or enclosed within the folded backing card 1, which is now folded at two points forming three layers in a zigzag orientation.

The spatula/applicator 15 is inserted through the 12 mm hole 5 and the oval hole 9 beck into its original blister 14 such that the hook end 16 of the applicator 15 holds the folded packaging closed. This avoids exposure of the sticky mixing surface and contamination of the surrounding. The packaging can now be disposed of in a clean and easy manner.

Where in the description particular integers are described it is envisaged that their alternatives can be substituted as if they were individually set forth herein.

A particular example of the invention has been described and it is envisaged that improvements and modifications can take place without deporting from the scope of the attached claims.

What is claimed is:

1. A handyman package for single or two part contents including:

a backing card formed with a plurality of holes and with at least one fold line;

a member fixed to the backing card so as to cover and seal said holes;

a cover sheet laminated to said membrane and including a corresponding number of blisters as there are holes formed in the backing card, such that when the cover sheet is laminated over the membrane and backing card, each blister is positioned over a sealed said hole in the backing card, whereby in use at least one of said sealed holes is opened and after use part of the backing card can be folded to cover said at least one hole.

2. A handyman package as claimed in claim 1 wherein the package has three blisters, corresponding to three holes in the backing card, such that a first blister contains a first contents, a second blister contains a second contents and a third blister contains an applicator.

3. A handyman package as claimed in claim 2 wherein the first contents is a first part of a two part reactive adhesive and the second contents is a second part of a two part reactive adhesive.

4. A handyman package as claimed in claim 3 wherein the backing card is provided with a first fold line and a second fold line on opposite sides of the backing card such that the two fold lines divide the backing card into three sections that can be folded in a zigzag Z shape when viewed from the side.

5. A handyman package as claimed in claim 4 wherein the first and second blisters are oval in shape and are located on the middle section of the backing card along with their corresponding holes.

6. A handyman package as claimed in claim 5 wherein the third blister is elongated in shape and is positioned substantially in a third section of the backing card, but partly positioned across the second fold line dividing the second and third sections and a corresponding third hole also partially across said second fold line such that when the third section of the backing card is folded forward through 90° the applicator is caused to erupt through the membrane covering said corresponding third hole so that the applicator can be withdrawn from the third blister.

7. A handyman package as claimed in claim 6 wherein the applicator is used to rupture the membrane sealing the holes corresponding to the first and second blisters.

8. A handyman package as claimed in claim 7 wherein when the third section of the backing card is folded through 180° it will crush the first and the second blisters, discharging the contents of the blisters through their corresponding holes and onto the back of the backing card.

9. A handyman package as claimed in claim 8 wherein the back of the backing card can be used as a platform for mixing and distribution of the first and second contents.

10. A handyman package as claimed in claim 7 wherein the back of the backing card can be used as a platform for mixing and distribution of the first and second contents.

11. A handyman package as claimed in claim 10 wherein an additional hole is punched through the backing card so that the backing card suspends the packaging from a display stand.

12. A handyman package as claimed in claim 7 wherein when the third section of the backing card is folded through 180° it will crush the first and second blisters, discharging the contents of the blisters through their corresponding holes onto the back of the backing card.

13. A handyman package which includes first contents and second contents, an applicator, a platform, a backing card with at least one fold line and a hole, means of transferring both of the contents to the platform, and means for easily and cleanly preparing the package for disposal after use, wherein the applicator is insertable through the hole such that it holds the package when folded flat in a zigzag orientation, thus making it cleanly and easily disposed of.

14. A handyman package as claimed in claim 13 wherein said backing card is formed with a plurality of holes; a membrane fixed to the backing card so as to cover and seal said holes; a cover sheet laminated to said membrane and backing card and including a corresponding number of blisters as there are holes formed in the backing card, such that when the cover sheet is laminated over the membrane and backing card each blister is positioned over a sealed hole in the backing card.

15. A handyman package as claimed in claim 14 wherein after contents of the blisters have been used for a task at hand, a first section of the backing card is folded backward 180° along the first fold line so as to meet a second section and enclose the surface of the platform and any unused contents thereon.

16. A handyman package for two part contents including:

a backing card formed with a plurality of holes and with a first fold line and a second fold line on opposite sides of the backing card such that the two fold lines divide the backing card into three sections that can be folded into a zigzag Z shape when viewed from the side;

a membrane fixed to the backing card so as to cover and seal said holes;

a cover sheet laminated to said membrane and including a corresponding number of blisters as there are holes formed in the backing card, such that when the cover sheet is laminated over the membrane and backing card, each blister is positioned over a sealed said hole in the backing card, whereby in use at least one of said sealed holes is opened and after use part of the backing card can be folded to cover said at least one hole, a first blister contains a first contents, a second blister contains a second contents and a third blister contains an applicator, the first contents is a first part of a two part reactive adhesive and the second contest is a second part of a two part reactive adhesive.

17. A handyman package which includes first contents and second contents, an applicator, a backing card forming a mixing platform, means of transferring both of the contents to the platform, and means for easily and cleanly preparing the package for disposal after use, the backing card being formed in three sections with a set of at least three holes, a membrane fixed to the backing card so as to cover and seal said set of holes; a cover sheet laminated to said membrane and backing card and including a corresponding number of blisters as there are holes in the set of holes formed in the backing card, such that when the cover sheet is laminated over the membrane and backing card each blister is positioned over a sealed hole in the backing card, the arrangement being such that first and second blisters which include said first contents and second contents are on a second section of the backing card;

the first and second contents are removed by puncturing their respective blisters such as with the applicator and by folding a third section of the backing card against the blister, so that the first and second contents are transferred to the mixing platform, after the contents of the blister have been used for a task at hand, a first section of the backing card is folded 180° along the first fold line so as to meet a second section of the backing card and thereby enclose the surface of the platform and any unused contents thereon, the applicator is then inserted through an additional hole in the first section, and into the third blister such that it holds the folded package flat in a zigzag orientation, thus making it cleanly and easily disposed of.

* * * * *